US006134518A

United States Patent [19]

Cohen et al.

[11] Patent Number: 6,134,518

[45] Date of Patent: Oct. 17, 2000

[54] DIGITAL AUDIO SIGNAL CODING USING A CELP CODER AND A TRANSFORM CODER

[75] Inventors: Gilad Cohen, Haifa; Yossef Cohen, Nesher; Doron Hoffman, Kiryat Motzkin; Hagai Krupnik; Aharon Satt, both of Haifa, all of Israel

[73] Assignee: International Business Machines Corporation, Armonk, N.Y.

[21] Appl. No.: 09/034,931

[22] Filed: Mar. 4, 1998

[30] Foreign Application Priority Data

Mar. 4, 1997 [EP] European Pat. Off. ..... 97480008

[51] Int. Cl.[7] ..... G10L 11/02; G10L 19/04

[52] U.S. Cl. ..... 704/201; 704/203; 704/219; 704/217; 704/240

[58] Field of Search ..... 704/203, 208, 704/210, 214, 215, 217, 219, 220, 216, 240, 201

[56] References Cited

U.S. PATENT DOCUMENTS

| | | | |
|---|---|---|---|
| 4,330,689 | 5/1982 | Kang et al. | 704/219 |
| 4,677,671 | 6/1987 | Galand et al. | 704/212 |
| 4,922,510 | 5/1990 | Brusewitz | 375/241 |
| 5,206,884 | 4/1993 | Bhaskar | 375/254 |
| 5,680,512 | 10/1997 | Rabowsky et al. | 704/504 |
| 5,710,863 | 1/1998 | Chen | 704/230 |
| 5,737,717 | 4/1998 | Akagiri et al. | 704/205 |
| 5,774,837 | 6/1998 | Yeldener et al. | 704/208 |
| 5,778,335 | 7/1998 | Ubale et al. | 704/219 |
| 5,859,826 | 1/1999 | Ueno et al. | 369/59 |
| 5,878,391 | 3/1999 | Arts | 704/233 |
| 5,982,817 | 11/1999 | Wuppermann | 375/244 |

*Primary Examiner*—David R. Hudspeth
*Assistant Examiner*—Abul K. Azad
*Attorney, Agent, or Firm*—Ratner & Prestia

[57] ABSTRACT

Apparatus is described for digitally encoding an input audio signal for storage or transmission. A distinguishing parameter is measure from the input signal. It is determined from the measured distinguishing parameter whether the input signal contains an audio signal of a first type or a second type. First and second coders are provided for digitally encoding the input signal using first and second coding methods respectively and a switching arrangement directs, at any particular time, the generation of an output signal by encoding the input signal using either the first or second coders according to whether the input signal contains an audio signal of the first type or the second type at that time. A method for adaptively switching between transform audio coder and CELP coder, is presented. In a preferred embodiment, the method makes use of the superior performance of CELP coders for speech signal coding, while enjoying the benefits of transform coder for other audio signals. The combined coder is designed to handle both speech and music and achieve an improved quality.

20 Claims, 6 Drawing Sheets

DIGITAL AUDIO SIGNAL CODING USING A CELP CODER AND A TRANSFORM CODER

CROSS REFERENCES TO RELATED APPLICATIONS

The present invention is related to the below-listed copending applications filed on the same date and commonly assigned to the assignee of this invention: FR9 97 010.

BACKGROUND OF THE INVENTION

1. Field of the Invention

This invention relates to digital coding of audio signals and, more particularly, to an improved wideband coding technique suitable, for example, for audio signals which include a mixture of music and speech.

2. Background Description

The need for low bitrate and low delay audio coding, such as is required for video conferencing over modern digital data communications networks, has required the development of new and more efficient schemes for audio signal coding.

However, the differing characteristics of the various types of audio signals has the consequence that different types of coding techniques are more or less suited to certain types of signals. For example, transform coding is one of the best known techniques for high quality audio signal coding in low bitrates. On the other hand, speech signals are better handled by model-based CELP coders, in particular for the low delay case, where the coding gain is low due to the need to use a short transform.

SUMMARY OF THE INVENTION

It is an object of the present invention to provide an improved audio signal coding technique which exploits the benefits of different coding approaches for different types of audio signals.

In brief, this object is achieved by apparatus for digitally encoding an input audio signal for storage or transmission, comprising: logic for measuring a distinguishing parameter for the input signal; determining means for determining from the measured distinguishing parameter whether the input signal contains an audio signal of a first type or a second type; first and second coders for digitally encoding the input signal using first and second coding methods respectively; and a switching arrangement for, at any particular time, directing the generation of an output signal by encoding the input signal using either the first or second coders according to whether the input signal contains an audio signal of the first type or the second type at that time.

In a preferred embodiment, the distinguishing parameter comprises an autocorrelation value, the first coder is a Codebook Excited Linear Predictive (CELP) coder and the second coder is a transform coder. This results in a high quality versatile wideband coding technique suitable, for example, for audio signals which include a mixture of music and speech.

One preferred feature of embodiments of the invention is a classifier device which adaptively selects the best coder out of the two. Other preferred features relate to ensuring smooth transition upon switching between the two coders.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF PREFERRED EMBODIMENTS OF THE INVENTION

Figure 1:
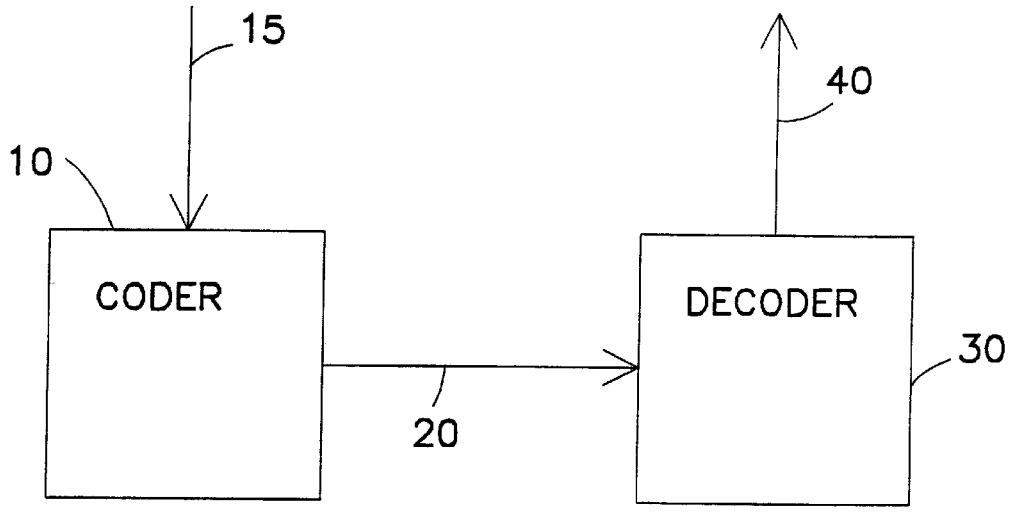
FIG. 1 shows in generalized and schematic form an audio signal coding system.

FIG. 1 shows a generalized view of an audio signal coding system. Coder 10 receives an incoming digitized audio signal 15 and generates from it a coded signal. This coded signal is sent over transmission channel 20 to decoder 30 wherein an output signal 40 is constructed which resembles the input signal in relevant aspects as closely as is necessary for the particular application concerned. Transmission channel 20 may take a wide variety of forms including wired and wireless communication channels and various types of storage devices. Typically, transmission channel 20 has a limited bandwidth or storage capacity which constrains the bit rate, ie the number of bits required per unit time of audio signal, for the coded signal.

Figure 2:
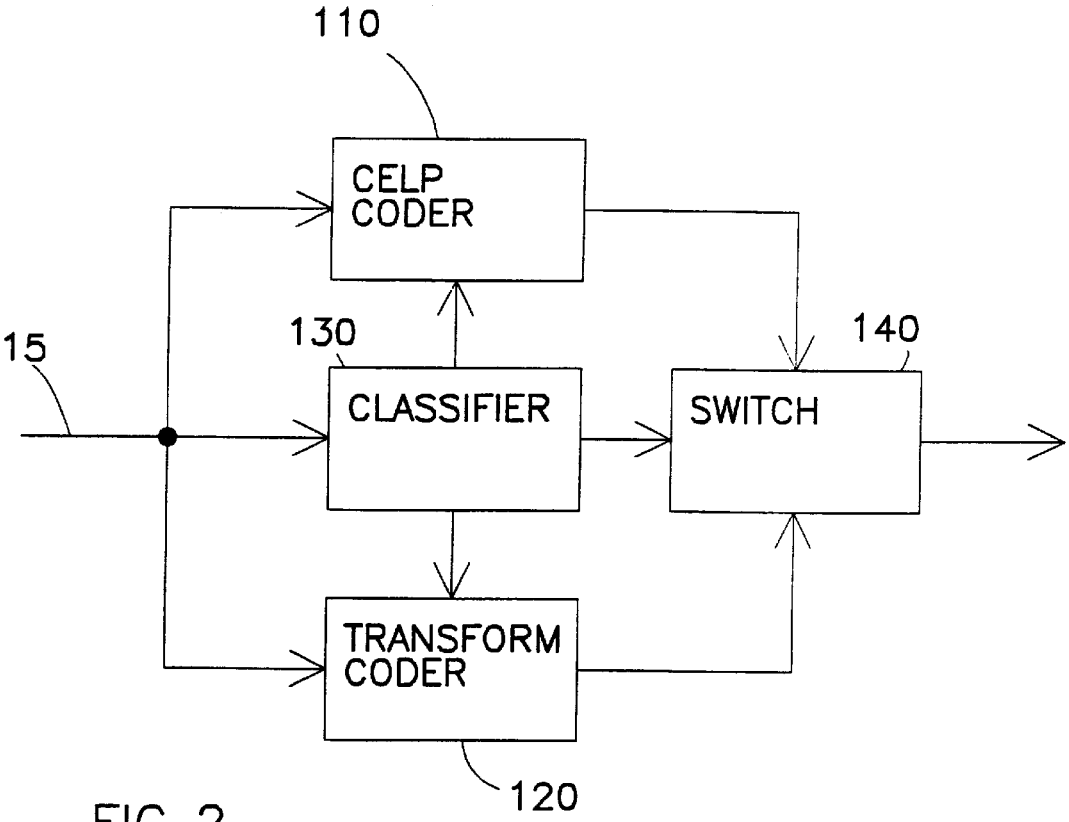
FIG. 2 is a schematic block diagram of the audio signal coder of FIG. 1.

FIG. 2 is a schematic block diagram of audio signal coder 10 in the preferred embodiment of the invention. Input signal 15 is fed in to speech state coder 110, music state coder 120 and classifier device 130. In this embodiment speech state coder 110 is a Codebook Excited Linear Predictive (CELP) coder and music state coder 120 is a transform coder. Input signal 15 is a digitized audio signal, including speech, at the illustrative sampling rate and bandwidth of 16 KHz and 7 KHz respectively. As is conventional, the input signal samples are divided in to ordered blocks, referred to as frames. Illustratively, the frame size is 160 samples or 10 milliseconds. Both CELP coder 110 and transform coder 120 are arranged to process the signal in frame units and to produce coded frames at the same bit rate.

Classifier device 130 is independent of the two coders 110 and 120. As will be described in more detail below, its purpose is to make an adaptive selection of the preferred coder, based on a measurement of the autocorrelation of the input signal which serves to distinguish between different types of audio signal. Typical speech signals and certain harmonic music sounds trigger the selection of CELP coding, whereas for other signals the transform coder is activated. The selection decision is transferred from the classifier 130 to both coders 110 and 120 and to switch circuit 140, in order to enable one coder and disable the other. The switching takes place at frame boundaries. Switch 140 transfers the selected coder output as output signal 150, and provides for smooth transition upon switching.

One bit of each coded frame is used to indicate to decoder 30 whether the frame has been encoded by CELP coder 110 or transform coder 120. Decoder 30 includes suitable CELP and transform decoders which are arranged to decode each frame accordingly. Apart from the minor modifications to be described below, the CELP and transform decoders in decoder 30 are conventional and will not be described in any detail herein.

The selection scheme used by classifier 130 is based on a statistical model that classifies the input signal as "speech" or "music" based on the signal autocorrelation. Denoting the input audio signal samples of the current frame by x(0), x(1), . . . x(N−1), then the autocorrelation series is given by:

$$R(k) = \frac{\sum_{n=0}^{N-1} x(n)x(n-k)}{\sqrt{\sum_{n=0}^{N-1} x(n)x(n) \sum_{n=0}^{N-1} x(n-k)x(n-k)}}$$

where the calculation is carried out over the range of k=Lower_lim, Lower_lim+1, . . . Upper_lim. Illustrative values for the limits are Lower_lim=40, and Upper_lim=290, which correspond to the pitch range of human speech. The maximum value of R(k) over the calculation range is referred to as the signal autocorrelation value of the current frame.

It will be understood that, in practice, the autocorrelation series may be calculated recursively rather than by summation over a block of signal samples and that autocorrelation values may be calculated separately for sub-frames, where the average or the maximum of the sub-frame values is taken as the autocorrelation value of the current frame.

Figure 3:
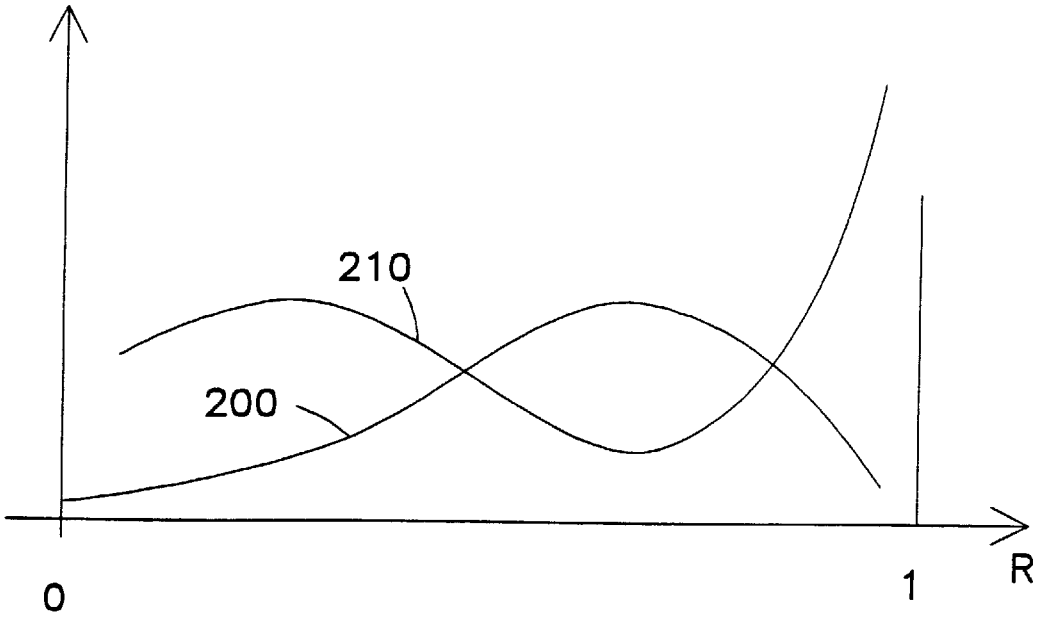
FIG. 3 illustrates a plot of a typical probability density function of the autocorrelation for speech and music signals.

FIG. 3 is a graph on which are shown typical probability density functions of the autocorrelation values R for speech signals at 200 and for music passages at 210. The plot is based on histograms measured over a collection of signals. The difference between the two probability density functions, which can be seen clearly in FIG. 3, forms the basis for discrimination between speech-type signals which are better handled by CELP coder 110 and music-type signals which are better handled by transform coder 120.

Assuming equal a priori probabilities of speech and music, P(speech)=P(music)=0.5, as an illustration, and using Bayes rule, the conditional probability function of speech given autocorrelation value R is:

$$p(\text{speech} \mid R) = \frac{p(R \mid \text{speech})}{p(R \mid \text{speech}) + p(R \mid \text{music})}.$$

Figure 4:
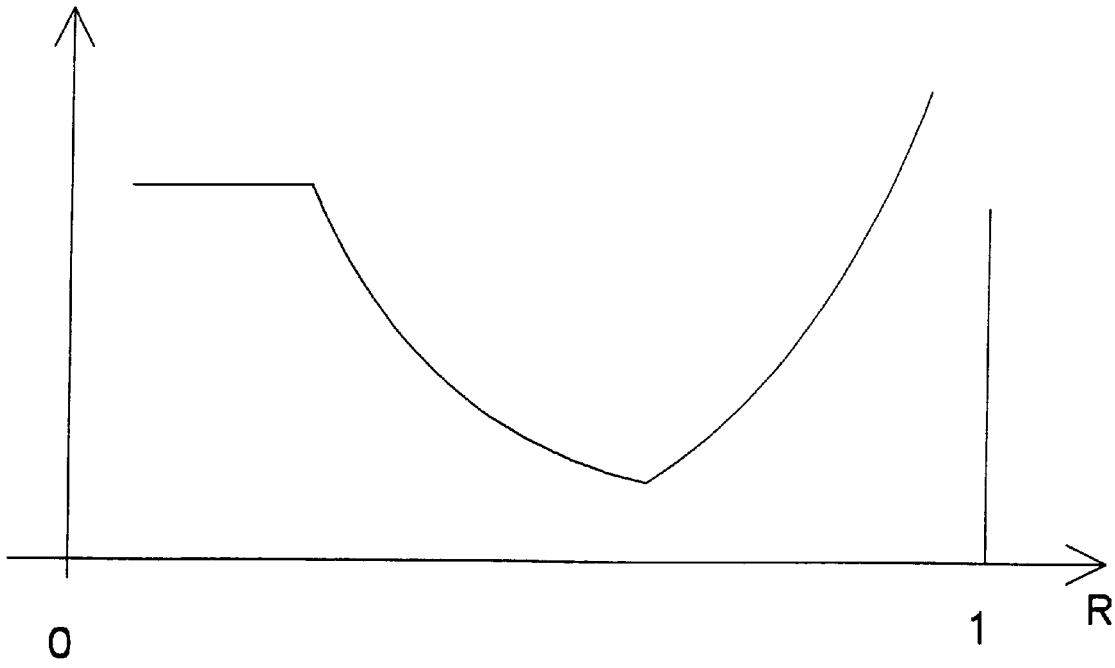
FIG. 4 illustrates a plot of the conditional probability density of speech signal given autocorrelation value.

The function p(speechIR) is illustrated in FIG. 4, as a parametric curve.

In classifier 130, a sequence of p(speech|R) values over successive frames is averaged, and the averaged sequence is taken as the basis for switching. This prevents rapid change and provides better smoothness. Illustratively, the averaged conditional probability function is calculated as:

$$p_{av}(i)=\alpha p_{av}(i-1)+(1-\alpha)p(\text{speech}|R(i)$$

where $p_{av}(i)$ is the calculated averaged probability function of the current frame, $p_{av}(i-1)$ is the averaged probability function of the previous frame, R(i) is the current frame autocorrelation value, and $\alpha$ is a memory factor illustratively between 0.90 and 0.99. The value of $\alpha$ may depend on the active state—speech or music. The recursion equation is initialized to the assumed a priori probability of speech: $p_{av}(i-1)=0.5$ upon initialization.

The switching logic is as follows: when in speech state, $$p_{av}(i)=\alpha_{speech}p_{av}(i-1)+(1+\alpha_{speech})p(\text{speech}|R(i)$$

switch to music state if $p_{av}(i)$<threshold(speech); when in music state, $$p_{av}(i)=\alpha_{music}p_{av}(i-1)+(1-\alpha_{music})p(\text{speech}|R(i))$$

switch to speech state if $p_{av}(i)$>threshold(music).

Illustratively, threshold(speech)=0.45 and threshold (music)=0.6. The value of threshold(speech) should be below the value of threshold(music), and an appropriate difference between these values is maintained to avoid rapid switching.

In the preferred embodiment, the speech state coder 110 is based on the well-known CELP model. A general description of CELP models can be found in Speech Coding and Synthesis, W. B. Kleijn and K. K. Paliwal editors, Elsevier, 1995.

Figure 5:
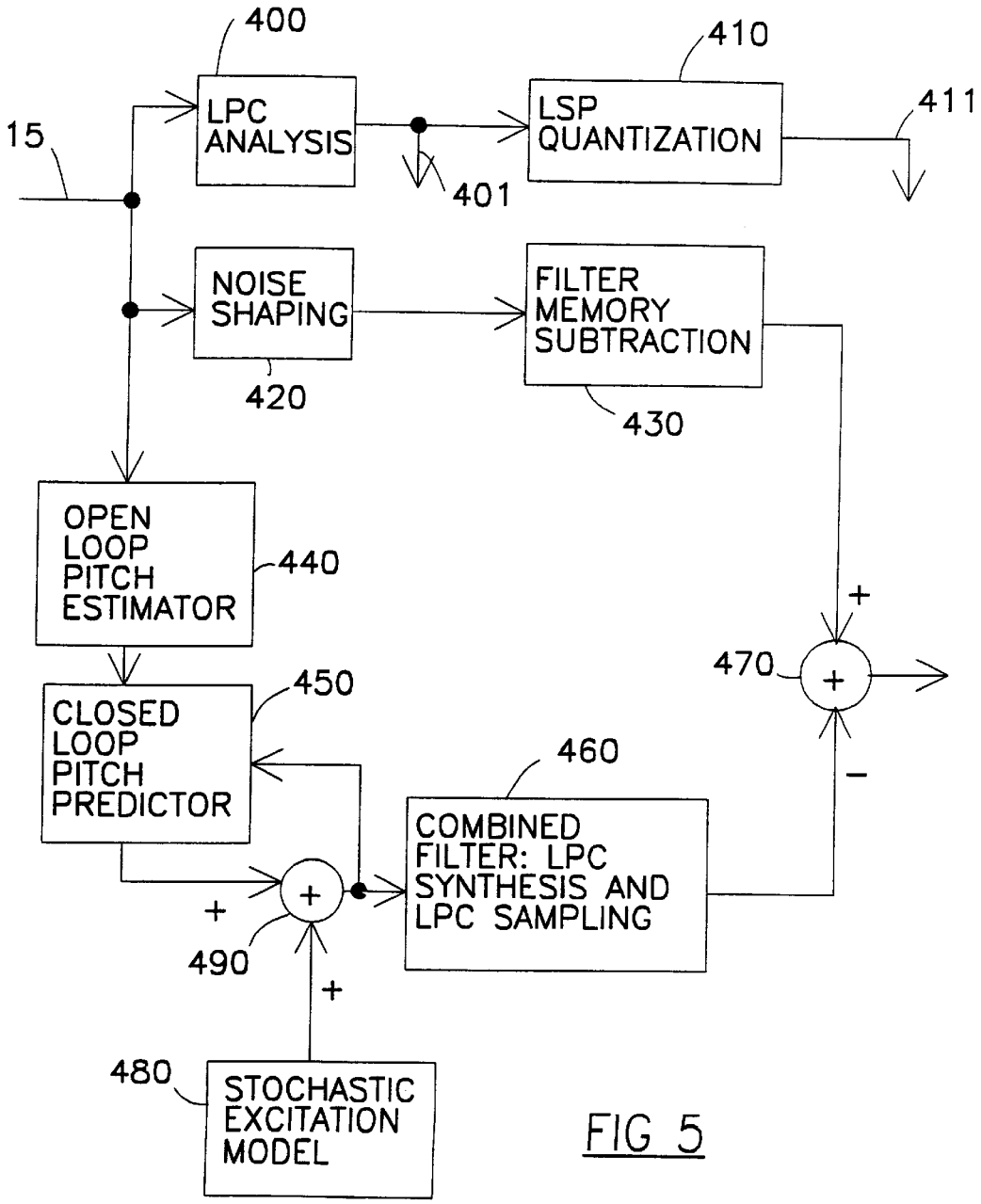
FIG. 5 is a schematic diagram showing the CELP coder of FIG. 2.

FIG. 5 is a schematic diagram showing the CELP coder 110. Referring to FIG. 5, input signal 15, is fed in to the Linear Predictive coding (LPC) analysis circuit 400, which is followed by the Line Spectral Pair (LSP) quantizer 410. The terms LPC and LSP are well understood in the art. The output of circuits 400 and 410 is the LPC and the quantized LPC parameters, which are obtained at outputs 401 and 411 respectively. Input signal 15 is also fed in to noise shaping filter 420. The noise-shaped signal is used as a target signal for a codebook search, after filter memory subtraction via circuit 430.

Following LPC analysis and quantization, a two step process is carried out in order to find the best excitation vector for the current frame signal.

Step 1. Input signal 15 is fed in to pitch estimator circuit 440, which produces the open loop pitch value. The open loop pitch value is used for closed loop pitch prediction in circuit 450. The closed loop prediction process is based on past samples of the excitation signal. The output of the closed loop predictor circuit 450, referred to as the adaptive codebook (ACBK) vector, is fed in to the combined filter circuit 460. Combined filter circuit 460, which consists of a cascaded synthesis filter and noise shaping filter, produces a partial synthesized signal. It is subtracted from the target signal via adder device 470, to form an error signal. The search for the best ACBK vector aims at minimizing the error signal energy.

Step 2. Once the best ACBK vector has been determined, the search for the best stochastic excitation takes place. The output of the stochastic excitation model, circuit 480, referred to as the Fixed codebook (FCBK) vector, is added to the ACBK vector via adder device 490, to form the excitation signal. The excitation is fed in to the filter circuit 460 to produce the synthesized signal. The error signal is calculated by adder device 470, and the search for the best FCBK vector is performed via minimization of the error signal energy.

The information carried over to the decoder consists of quantized LPC parameters, pitch prediction data and FCBK vector information. This information is sufficient to reproduce the excitation signal within decoder 30, and to pass it through a synthesis filter to get the output signal 40.

In the preferred embodiment, the music state coder 120 is based on well known transform coding techniques which employ some form of discrete frequency domain transform. A description of these techniques can be found in "Lapped Transforms for Efficient Transform/Subband Coding", H. Malver, IEEE trans. on ASSP, vol.37, no. 7, 1989. Illustratively, an orthogonal lapped transform, and in particular the modified Discrete Cosine Transform (MDCT), is used.

Figure 6:
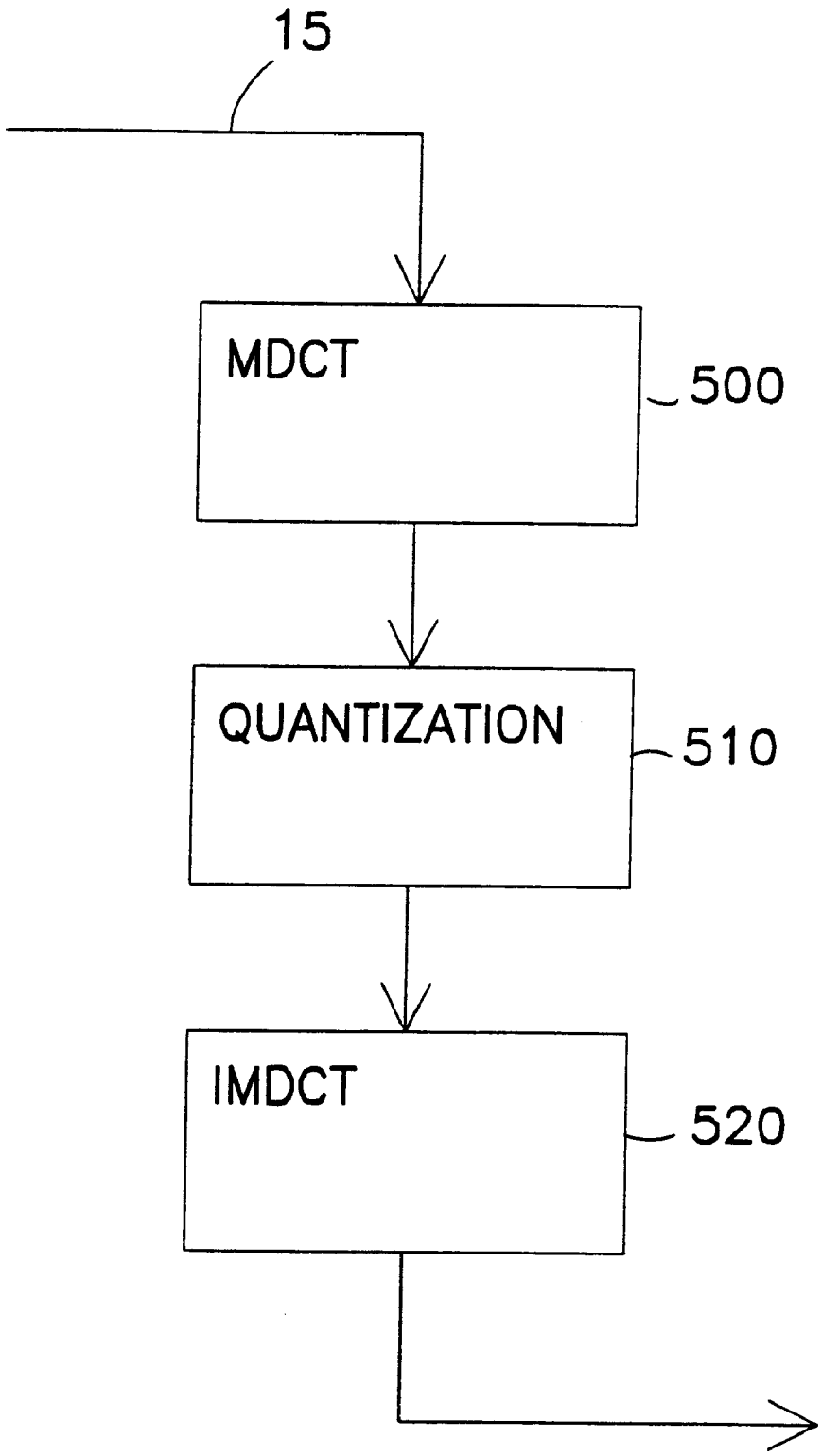
FIG. 6 is a schematic diagram illustrating the transform coding system.

FIG. 6 is a schematic diagram showing the transform encoding and decoding. Referring to FIG. 6, 320 samples of input signal 100 are transformed to 160 coefficients via a conventional MDCT circuit 500. These 160 coefficients represents the linear projection of the 320 input samples over the transform sub-space, and the orthogonal component of these samples is included within the preceding and the following frames.

The first 160 signal samples form the effective frame, whereas the other 160 samples are used as a look-ahead for the overlap windowing. The transform coefficients are quantized in circuit 510 for transmission to decoder 30. In decoder 30, the coefficients are inverse transformed via Inverse MDCT (IMDCT) circuit 520. The output of the IMDCT consists of 320 samples, that produce the output signal by overlap-adding to orthogonal complementary parts of preceding and following frames. Only 160 samples of the output signal are reconstructed in the current frame, and the remaining 160 samples of the IMDCT output are overlapped-added to the orthogonal complementary part of the following frame.

In the preferred embodiment, a smooth transition scheme, that requires no additional delay to the one-frame look ahead, is employed in order to switch from the speech state to the music state. Several changes to a conventional CELP coder and decoder are required, due to the overlapping window of the transform coder. These changes are as follows.

1. At the encoder, an extended signal segment is coded on the last frame, to include the window look ahead.
2. At the decoder, the extended signal is decoded.
3. At the decoder, the orthogonal part is removed from the signal extension, to allow for overlap-add with the following transform coded frame.

Predictive coding may be used within the transform coder as described in copending application ref FR9 97 010 filed on the same date and commonly assigned to the assignee of this invention. A copy of this co-pending patent application is available on the European Patent Office file for the present application. In this case it will be understood that initial conditions would need to be restored, which may be carried out in any suitable manner.

In normal operation, the CELP coder encodes, and the CELP decoder decodes, one frame of 160 samples at a time, using a look ahead signal of up to 160 samples. The look ahead size is determined by the transform coder window length.

Upon a switching decision from the speech state to the music state, a last, extended, CELP frame is produced, followed by transform-coded frames. The extended frame carries information of 320 output samples, which requires extended definitions of the ACBK and the FCBK vector structure. In the present embodiment which uses fixed bitrate coding, no additional bits are available for the coding of the extended signal. This results in some quality degradation. However, it has been found that acceptable quality is obtainable if rapid switching is avoided. The coding quality of the last frame can be improved by omitting the ACBK component and augmenting the FCBK information. This is due to the fact that low signal autocorrelation is expected upon switching in to music state.

After decoding the 320 samples of the extended CELP frame, the orthogonal part is removed from the last 160 samples, as follows.

Denoting the 320 output samples by $x(0), x(1), \ldots x(319)$, a vector y is defined as $y(n)=0$, $n=0, 1, \ldots 159$, and $y(n)=x(n)$, $n=160, \ldots 319$.

The IMDCT is calculated of the MDCT of y(n), and the result denoted by z(n).

The samples x(n), $n=160, \ldots 319$, are replaced by the samples z(n), $n=160, \ldots 319$.

After removing the orthogonal component, the output signal can be overlap-added to the following transform-coded frame.

In the preferred embodiment, a smooth transition scheme, that requires no additional delay to the one-frame look ahead, is employed in order to switch from the music state to the speech state. Several changes to the conventional CELP coder and decoder are required, due to overlapping window of the transform coder and the need to reproduce initial conditions.

The changes are as follows.

1. At the decoder, the orthogonal part is removed from the output signal of the first CELP encoded frame, to allow for overlap-add with the preceding transform coded frame.
2. At the encoder and at the decoder, the predictive coding of LSP parameters is initialized.
3. At the encoder and at the decoder, the excitation memory is initialized for the pitch prediction process.
4. At the encoder, the initial conditions (memory) of the noise shaping filter 420, and the combined filter 460, shown in FIG. 4 are reconstructed.
5. At the decoder, the initial conditions of the synthesis filter are reconstructed.

The switching from transform coding in to CELP coding takes place immediately following the switching decision from the music state to the speech state.

The orthogonal part is removed from the CELP decoder output for the first CELP encoded frame as follows.

Denoting the 160 output samples by $x(0), x(1), \ldots x(159)$, a vector y is defined as $y(n)=x(n)$, $n=0, 1, \ldots 159$, and $y(n)=0$, $n=160, \ldots 319$.

The IMDCT is calculated of the MDCT of y(n), denoting the result by z(n).

The samples x(n) are replaced by the samples z(n).

After removing the orthogonal component, the output signal can be overlap-added to the preceding transform-coded frame in order to produce the decoded output for that preceding frame.

The LSP quantization process, as described in Speech Coding and Synthesis, W. B. Kleijn and K. K. Paliwal editors, Elsevier, 1995 is started by assuming long-term average values to the LSP parameters on the last transform-coded frame, as is common practice.

Once the quantized LPC parameters are available, following LSP decoding, the excitation signal is restored by inverse filtering. The output signal of the last transform-coded frame, that is the first 160 samples that are fully reconstructed, is passed through the inverse of LPC the synthesis filter, to produce a suitable excitation. This inverse-filtered excitation is used as a replacement for the true excitation vector for the purpose of reconstructing initial conditions of filters.

There has been described a method of processing an ordered time series of signal samples divided into ordered blocks, referred to as frames, the method comprising, for each said frame, the steps of: (a) calculating an autocorrelation sequence of the said frame, and defining the maximum value of the said autocorrelation sequence to be the autocorrelation of the said frame; (b) using an empirical probability function of speech given autocorrelation value, to calculate the probability of speech given said autocorrelation; (c) calculating an averaged probability of speech given said autocorrelation by averaging the said probability of speech given said autocorrelation over said frames; (d) determining the state of the said frame, "speech state" or "music state", based on the value of said averaged probability of speech given said autocorrelation; (e) upon changing from said speech state to said music state performing an extended CELP coding of the said frame, to be followed by transform coding of said frames, until next change of the said state; (f) upon changing from said music state to said speech state performing a special CELP coding of the said frame, to be followed by CELP coding of said frames, until next change of the said state.

The extended CELP coding refers to modified CELP coding of said frame in order to provide extended output signal for overlap-adding to transform coder output signal and which reproduces initial conditions within said CELP coding, and provides output signal for overlap-adding to transform coder output signal.

As described above, the determining of the state of the said frame, can be via a decision based on comparing the value of the said averaged probability of speech given said autocorrelation to a pre-determined threshold.

The output signal for overlap-adding to transform coder output signal, refers to the output signal of said CELP coding, after removal of the orthogonal component of the transform coding scheme.

The autocorrelation of the frame, may be the average or maximum value of the autocorrelation of sub-frames of the said frame.

The empirical probability function of speech given autocorrelation, can be determined from empirical probability density functions of autocorrelation for speech and for music, using Bayes rule.

The CELP coding can include speech coding schemes based on stochastic excitation codebooks, including vector-sum excitation or speech coding schemes based on multi-pulse excitation or other pulse-based excitation.

The transform coding can include audio coding schemes based on lapped transform including orthogonal lapped transform and MDCT.

It will be understood that the above described coding system may be implemented as either software or hardware or any combination of the two. Portions of the system which are implemented in software may be marketed in the form of, or as part of, a software program product which includes suitable program code for causing a general purpose computer or digital signal processor to perform some or all of the functions described above.

While the invention has been described in terms of preferred embodiments, those skilled in the art will recognize that the invention can be practiced with modification within the spirit and scope of the appended claims.

Having thus described our invention, what we claim as new and desire to secure by Letters Patent is as follows:

1. Apparatus for digitally encoding an input audio signal for storage or transmission wherein the input audio signal comprises a series of signal samples ordered in time and divided into frames, comprising:

logic for measuring a distinguishing parameter from the input signal, determining means for determining from the measured distinguishing parameter whether the input signal contains an audio signal of a first type or a second type;

first and second coders for digitally encoding the input signal using first and second coding methods respectively;

a switching arrangement for, at any particular time, directing the generation of an output signal by encoding the input signal using either the first or second coders according to whether the input signal contains an audio signal of the first type or the second type at that time; and wherein the first coder is a Codebook Excited Linear Predictive (CELP) coder and the second coder is a transform coder, each coder being arranged to operate on a frame-by-frame basis, the transform coder being arranged to encode a frame using a discrete frequency domain transform of a range of samples from a plurality of neighboring frames, and wherein the CELP coder is arranged to encode an extended frame to generate the last CELP encoded data prior to a switch from a mode of operation in which frames are encoded using the transform coder, the extended frame covers the same range of sample as the transform coder, so that a transform decoder can generate the information required to decode the first frame encoded using the transform coder from the last CELP encoded frame.

2. Apparatus as claimed in claim 1, wherein the distinguishing parameter comprises an autocorrelation value.

3. Apparatus as claimed in claim 1, wherein the input signal comprises a series of signal samples ordered in time and divided into frames and comprising means to provide and indication in the coded data stream for each frame as to whether the frame has been encoded using the first coder or the second coder.

4. Apparatus as claimed in claim 1, wherein the input signal comprises a series of signal samples ordered in time and divided into frames and comprising logic for calculating an autocorrelation sequence of each frame, wherein the determining means comprises:

means to calculate, using an empirical probability function, the probability of speech from said autocorrelation sequence;

means for calculating an averaged probability of speech by averaging the said probability of speech over a plurality of frames;

means to determine the state of each frame, as a "speech state" of "music state", based on the value of said averaged probability of speech.

5. Apparatus as claimed in claim 1, comprising means arranged to compare the averaged speech probability value with one or more thresholds to determine the state of each frame.

6. Apparatus for digitally decoding an input signal comprising coded data for a series of frames of audio data, comprising:

logic to detect an indication in the coded data stream for each frame as to whether the frame has been encoded using a first coder or a second coder;

first and second decoders for digitally decoding the input signal using first and second decoding methods respectively;

a switching arrangement, for each frame, directing the generation of an output signal by decoding the input signal using either the first or second decoders according to the detected indication; and wherein the first decoder is a CELP decoder and the second decoder is a transform decoder and when switching from the mode of operation of decoding CELP encoded frames to transform encoded frames, the transform coder uses the information in an extended CELP frame when decoding the first frame encoded using the transform coder.

7. A method for digitally encoding an input audio signal for storage or transmission wherein the input audio signal comprises a series of signal samlpes ordered in time and divided into frames, comprising:

measuring a distinguishing parameter from the input signal, determining from the measured distinguishing parameter whether the input signal contains an audio signal of a first type or a second type; and generating an output signal by encoding the input signal using either first or second coding methods according to whether the input signal contains an audio signal of the first type or the second type at that time, wherein the first coding method is CELP coding and the second coding method is transform coding, and wherein the input signal is coded on a frame-by-frame basis, the transform coding comprising encoding a frame using a discrete frequency domain transform of a range of samples from a plurality of neighboring frames, and wherein the CELP coding comprises generating the last CELP encoded frame prior to a switch from a mode of operation in which frames are encoded using the CELP coding to a mode of operation in which frames are encoded using transform coding by encoding an extended frame, the extended frame covering the same range of samples as the transform coding, so that a transform decoder can generate the information required to decode the first frame encoded using the transform coding from the last CELP encoded frame.

8. A method as claimed in claim 7, wherein the distinguishing parameter comprises an autocorrelation value.

9. A method as claimed in claim 7, wherein the input signal comprises a series of signal samples ordered in time and divided into frames and comprising providing an indication in the coded data stream for each frame as to whether the frame has been encoded using the first coding method or the second coding method.

10. A method as claimed in claim 7, wherein the input signal comprises a series of signal samples ordered in time and divide into frames and comprising:

calculating an autocorrelation sequence of each frame;

calculating, using an empirical probability function, the probability of speech from said autocorrelation sequence;

calculating an average probability of speech by averaging the said probability of speech over a plurality of frames;

determining the state of each frame, as a "speech state" or "music state", based on the value of said averaged probability of speech.

11. A method as claimed in claim 7, comprising comparing the averaged speech probability value with one or more thresholds to determine the state of each frame.

12. A coded representation of an audio signal produced using a method as claim in claim 7, and stored on a physical support.

13. A computer program product which includes suitable program code means for causing a general purpose computer or digital signal processor to perform a method as claimed in claim 7.

14. Apparatus for digitally encoding an input audio signal for storage or transmission wherein the input audio signal comprises a series of signal samples ordered in time and divided into frames, comprising:

logic for measuring a distinguishing parameter from the input signal, a determining module to determine from the measured distinguishing parameter whether the input signal contains an audio signal of a first type or a second type;

first and second coders for digitally encoding the input signal using first and second coding methods respectively;

a switching arrangement for, at any particular time, directing the generation of an output signal by encoding the input signal using either the first or second coders according to whether the input signal contains an audio signal of the first type or the second type at that time; and wherein the first coder is a CELP coder and the second coder is a transform coder, each coder being arranged to operate on a frame-by-frame basis, the transform coder being arranged to encode a frame using a discrete frequency domain transform of a range of samples from a pluralitv of neighboring frames, and wherein the CELP coder is arranged to encode an extended frame to generate the last CELP encoded data prior to a switch from a mode of operation in which frames are encoded using the transform coder, the extended frame cover the same range of sample as the transform coder, so that a transform decoder can generate the information required to decode the first frame encoded using the transform coder from the last CELP encoded frame.

15. Apparatus as claimed in claim 14, wherein the distinguishing parameter comprises an autocorrelation value.

16. Apparatus as claimed in claim 14, wherein the input signal comprises a series of signal samples ordered in time and divided into frames and comprising a provider module to provide and indication in the coded data stream for each frame as to whether the frame has been encoded using the first coder or the second coder.

17. Apparatus as claimed in claim 14, wherein the input signal comprises a series of signal samples ordered in time and divided into frames and comprising logic for calculating an autocorrelation sequence of each frame, wherein the determining module comprises:

a first calculator to calculate, using an empirical probability function, the probability of speech from said autocorrelation sequence;

a second calculator to calculate an averaged probability of speech by averaging the said probability of speech over a plurality of frames;

a state determining module to determine the state of each frame, as a "speech state" or "music state", based on the value of said averaged probability of speech.

18. Apparatus as claimed in claim 14, comprising a comparator module arranged to compare the averaged speech probability value with one or more thresholds to determine the state of each frame.

19. An article of manufacture comprising:

a computer usable medium having computer a readable program code module embodied therein for causing a digitally encoding of an input audio signal for storage or transmission wherein the input audio signal comprises a series of signal samples ordered in time and divided into frames, the computer readable program code module in said article of manufacture comprising:

computer readable program code module for causing a computer to effect, measuring a distinguishing parameter from the input signal, determining from the measured distinguishing parameter whether the input signal contains an audio signal of a first type or a second type; and generating an output signal by encoding the input signal using either first or second coding methods according to whether the input signal contains an audio signal of the first type or the second type at that time, wherein the first coding method is CELP coding and the second coding method is transform coding, and wherein the input signal is coded on a frame-by-frame basis. the transform coding comprising encoding a frame using a discrete frequency domain transform of a range of samples from a plurality of neighboring frames, and wherein the CELP coding comprises generating the last CELP encoded frame prior to a switch from a mode of operation in which frames are encoded using the CELP coding to a mode of operation in which frames are encoded using transform coding by encoding an extended frame, the extended frame covering the same range of samples as the transform coding, so that a transform decoder can generate the information required to decode the first frame encoded using the transform coding from the last CELP encoded frame.

20. A program storage device readable by machine, tangibly embodying a program of instructions executable by the machine to perform method steps for causing a digitally encoding of an input audio signal for storage or transmission wherein the input audio signal comprises a series of signal samples ordered in time and divided into frames, said method steps comprising:

measuring a distinguishing parameter from the input signal, determining from the measured distinguishing parameter whether the input signal contains an audio signal of a first type or a second type; and generating an output signal by encoding the input signal using either first or second coding methods according to whether the input signal contains an audio signal of the first type or the second type at that time, wherein the first coding method is CELP coding and the second coding method is transform coding, and wherein the input signal is coded on a frame-by-frame basis, the transform coding comprising encoding a frame using a discrete frequency domain transform of a range of samples from a plurality of neighboring frames, and wherein the CELP coding comprises generating the last CELP encoded frame prior to a switch from a mode of operation in which frames are encoded using the CELP coding to a mode of operation in which frames are encoded using transform coding by encoding an extended frame, the extended frame covering the same range of samples as the transform coding, so that a transform decoder can generate the information required to decode the first frame encoded using the transform coding from the last CELP encoded frame.

* * * * *